US006733050B1

(12) United States Patent
Yao

(10) Patent No.: US 6,733,050 B1
(45) Date of Patent: May 11, 2004

(54) BOLT DOCK FOR DOOR LOCK

(75) Inventor: Celina Yao, Nan Tou Hsien (TW)

(73) Assignee: Shyang Feng Electric & Machinery Co., Ltd., Nan Tou Hsien (TW)

( * ) Notice: Subject to any disclaimer, the term of this patent is extended or adjusted under 35 U.S.C. 154(b) by 29 days.

(21) Appl. No.: 10/291,433

(22) Filed: Nov. 12, 2002

(51) Int. Cl.[7] ..... E05L 1/12

(52) U.S. Cl. ..... 292/169; 292/32; 292/137; 292/333; 70/107

(58) Field of Search ..... 292/169, 163, 292/169.14, 333, 137, 32, 37; 70/107

(56) References Cited

U.S. PATENT DOCUMENTS 215,580 A * 5/1879 Daniels ..... 70/111
1,158,845 A * 11/1915 Prinzler ..... 70/151 R
3,672,714 A * 6/1972 Schultz ..... 292/34
3,808,849 A * 5/1974 Alexander ..... 70/149
3,917,329 A * 11/1975 Fujiki et al. ..... 292/163
4,118,056 A * 10/1978 Alexander ..... 292/169.17
4,322,958 A * 4/1982 Eigemeier ..... 70/107
4,890,870 A * 1/1990 Miron ..... 292/333
4,950,005 A * 8/1990 Cudd ..... 292/150
5,044,184 A * 9/1991 Herbers et al. ..... 70/277
5,813,255 A * 9/1998 Tell et al. ..... 70/107
5,960,656 A * 10/1999 Yao ..... 70/472
6,131,966 A * 10/2000 Hensley et al. ..... 292/139
6,145,353 A * 11/2000 Doucet ..... 70/277
6,174,004 B1 * 1/2001 Picard et al. ..... 292/165
6,209,931 B1 * 4/2001 Von Stoutenborough et al. 292/160
6,266,981 B1 * 7/2001 von Resch et al. ..... 70/107
6,282,929 B1 * 9/2001 Eller et al. ..... 70/109
6,393,878 B1 * 5/2002 Fayngersh et al. ..... 70/107
6,557,909 B2 * 5/2003 Morris ..... 292/DIG. 60
6,578,888 B1 * 6/2003 Fayngersh et al. ..... 292/332
6,581,423 B2 * 6/2003 Lin ..... 70/107
6,622,535 B2 * 9/2003 Chiang et al. ..... 70/107
6,640,594 B1 * 11/2003 Yao ..... 70/277
6,651,466 B1 * 11/2003 Shih ..... 70/107

* cited by examiner

*Primary Examiner*—Robert J. Sandy
*Assistant Examiner*—Carlos Lugo
(74) *Attorney, Agent, or Firm*—Rosenberg, Klein & Lee

(57) ABSTRACT

An improved bolt dock for a door lock and particularly a bolt dock capable of locking automatically when the door is closed and preventing the bolt from deforming mainly consists of an upper bolt set and a lower bolt set covered by a lid to couple with an inner handle and an outer handle to be installed on a door. The bolt dock thus made can achieve safe locking and increase the durability of the door lock.

5 Claims, 9 Drawing Sheets

BOLT DOCK FOR DOOR LOCK

BACKGROUND OF THE INVENTION

1. Field of the Invention

The invention relates to an improved bolt dock for a door lock, and particularly a bolt dock that is capable of locking automatically when the door is closed and preventing the bolt from deforming.

2. Description of the Prior Art

A conventional door lock 1 as shown in FIG. 1 generally includes an outer handle 11, an inner handle 12 and a bolt assembly 13. The bolt assembly includes a dead bolt 131 and a latch bolt 132. As the latch bolt 132 is smaller and tends to occur deformation after being used for a period of time, the durability of the entire door lock 1 is affected. Moreover, a general door lock 1 is required to lock automatically after the door is closed. Otherwise people who forget to lock the door inadvertently or leave the houses in a hurry without locking the door could make the house a tempting target for burglars and villains, and result in serious risks and safety concerns to the properties and people living in the house.

SUMMARY OF THE INVENTION

In view of the aforesaid disadvantages, the primary object of the invention is to provide an improved bolt dock for door locks that automatically locks the door when the door is closed, and prevents the bolt from deforming to achieve safe locking and increase service life of the lock.

The invention mainly includes a bolt dock that has an upper bolt set and a lower bolt set covering by a lid to couple with an inner handle and an outer handle for installing on a lock opening of a door to ensure safe locking and achieve longer durability of the lock.

The foregoing, as well as additional objects, features and advantages of the invention will be more readily apparent from the following detailed description, which proceeds with reference to the accompanying drawings.

DESCRIPTION OF THE PREFERRED EMBODIMENT

Figure 1:
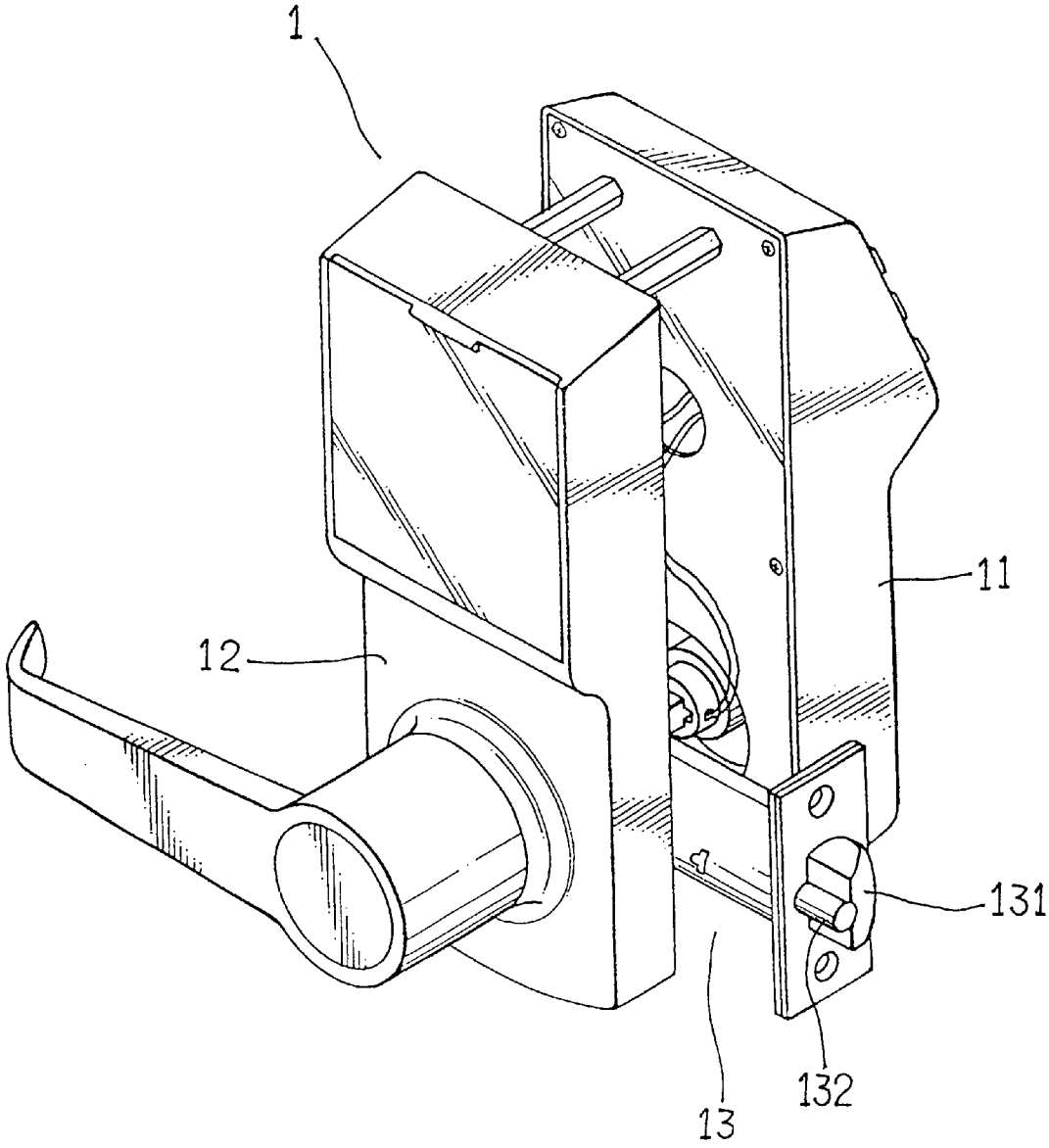
FIG. 1 PRIOR ART
FIG. 1 is a schematic view of the bolt of a conventional door lock.
Figure 2:
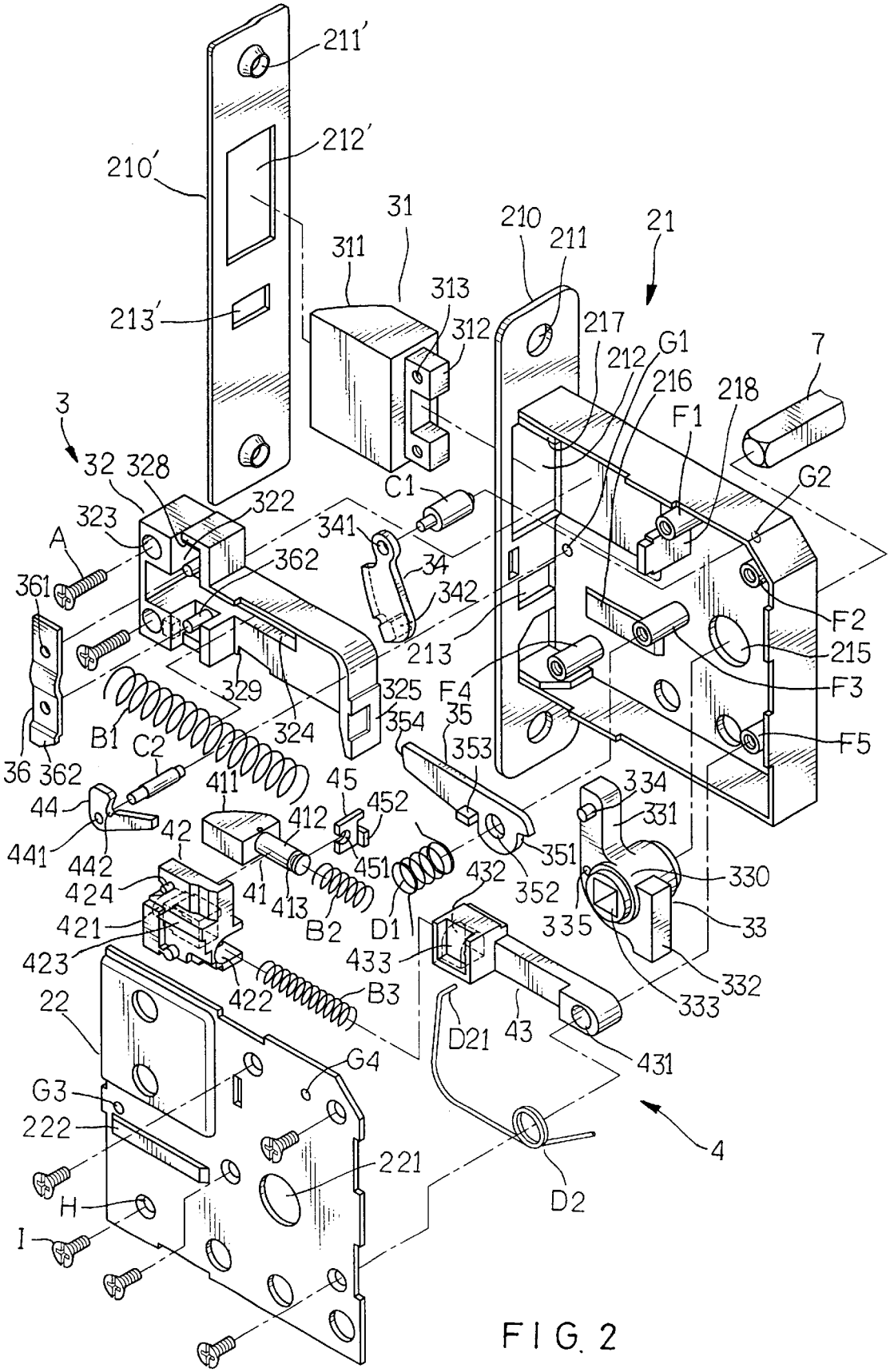
FIG. 2 is an exploded view of the invention.
Figure 3:
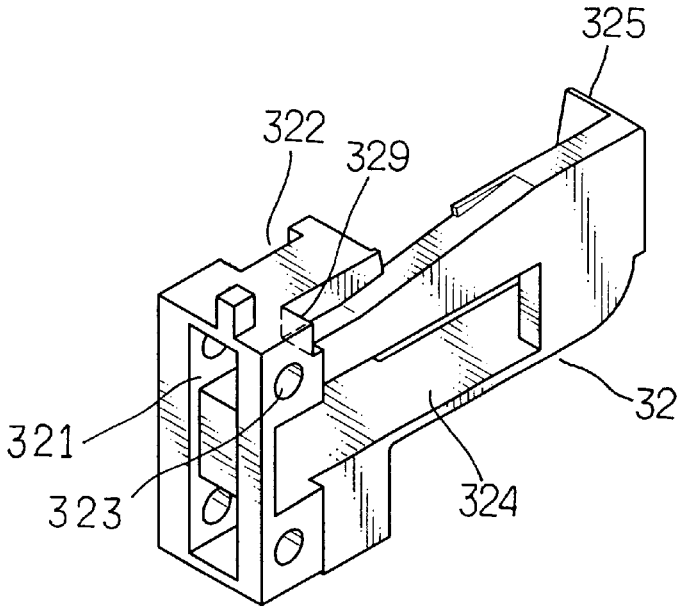
FIG. 3 is a schematic view of the bolt dock of the invention.
Figure 4:
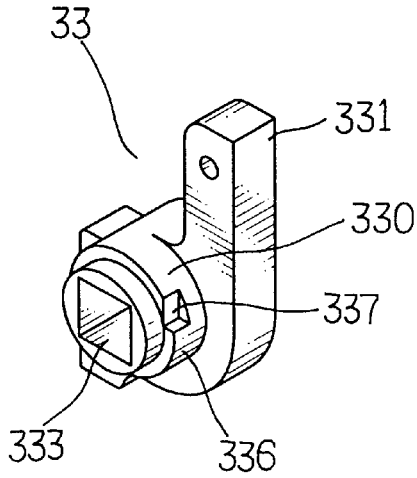
FIG. 4 is a schematic view of the axle member of the invention.
Figure 5:
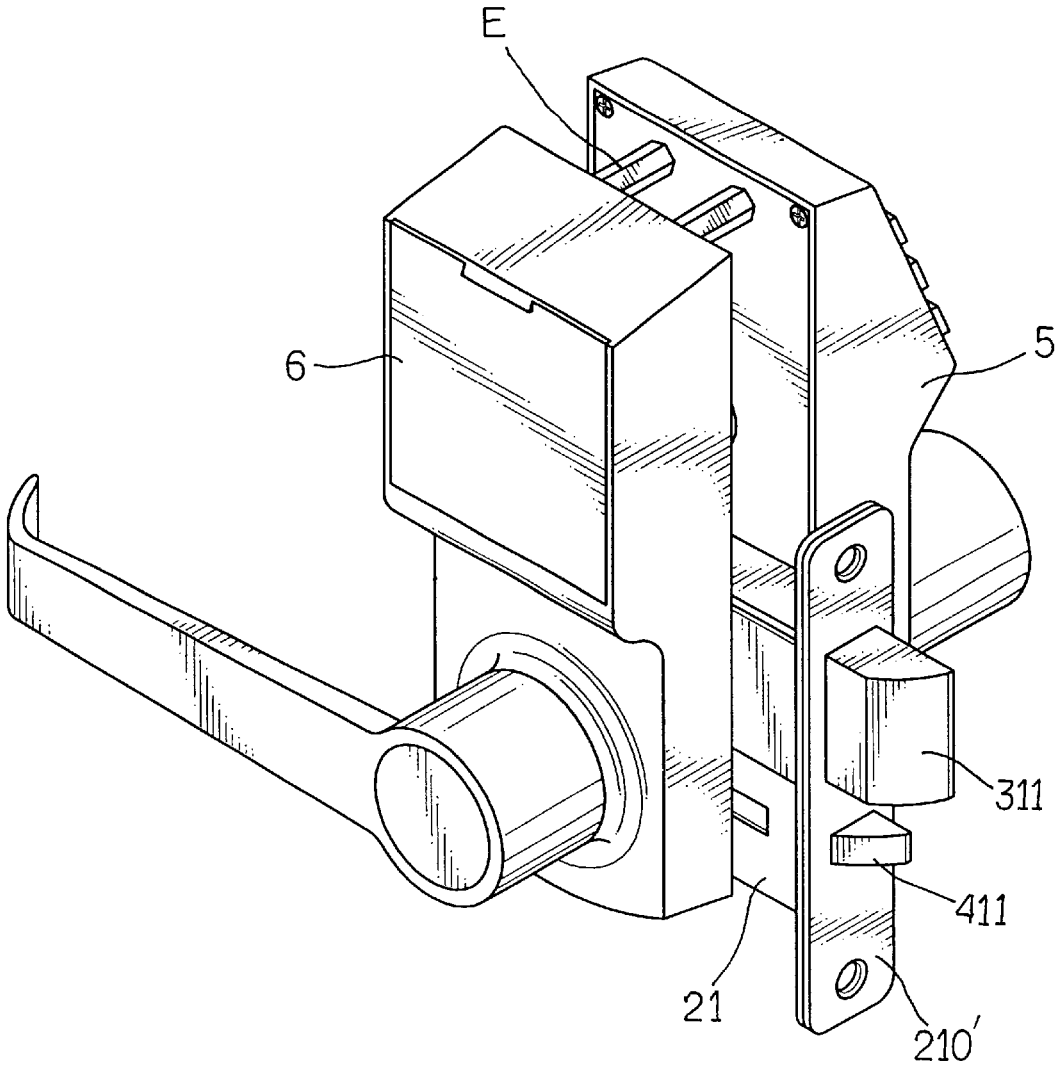
FIG. 5 is a schematic view of an embodiment of the invention.

Referring to FIGS. 2, 3, 4 and 5, the invention mainly includes a bolt dock 21 which has an upper bolt set 3 and a lower bolt set 4 that are covered by a lid 22, then are coupled with an outer handle 5 and an inner handle 6, and are installed on a door, wherein:

the bolt dock 21 has a casing which has a face plate 210 and a guard plate 210' located on one side. The face plate 210 and the guard plate 210' have respectively a plurality of fastening holes 211 and 211' located on the upper side and the lower side, and an upper bolt opening 212 and 212', and a lower bolt opening 213 and 213'. The holes and openings on the face plate are corresponding to that on the guard plate. Inside the bolt dock 21, there are a plurality of struts F1, F2, F3, F4 and F5 each has a screw hole formed therein, and a plurality of axle holes 215, G1 and G2. The bolt dock 21 further has a guide rail 216 located at a lower section below the center and a stop plate 217 located above the upper bolt opening 212. There is also a retaining plate 218 located on an upper section above the center of the bolt dock 21 corresponding to the upper bolt opening 212;

the lid 22 corresponds to the bolt dock 21 and has a plurality of axle holes G3, G4 and 221, and a plurality of apertures H corresponding to the struts F1, F2, F3, F4 and F5 to receive screws I for fastening. At the center of the lid 22, there is a transverse slide flute 222;

the upper bolt set 3 includes:

an upper bolt 31 for running through the upper bolt openings 212 and 212' of the bolt dock 21, and having a sloped surface 311 on one side and a fastening section 312 extending from another side. The fastening section 312 has two fastening holes 313;

a slide shank 32 having one side extended to form a ram head 325 and another side formed a wedge trough 321 to couple with the fastening section 312 of the upper bolt 31. The wedge trough 321 has a side wall with two fastening holes 323 formed thereon to engage with screws A. The slide shank 32 further has a longitudinal trough 322 formed on an inner side of the wedge trough 321 and a transverse trough 324 normal to the longitudinal trough in a staggered manner. The transverse trough 324 has one end receiving the retaining plate 218 to form a retaining position. The transverse trough 324 houses a spring B1. A cover plate 36 with two round holes 361 is provided to cover the longitudinal trough 322 and is fixedly mounted thereon by means of two rivets 362. On the upper side of the longitudinal trough 322, there is a retaining flange 328;

an axle member 33 having a hollow barrel 330 with a square opening 333 formed therein, an upper bucking arm 331 extending upwards and a lower bucking arm 332 extending downwards. The upper bucking arm 331 has one side forming a stub shaft 334, and a round hole 335 for receiving one end D21 of a spring D2. The hollow barrel 330 has a bottom rim 336 on another side with a notch 337 formed thereon. The axle member 33 is located between the bolt dock 21 and the lid 22 and is coupled with the axles holes 215 and 221;

a trigger plate 34 formed in an arched shape having an axle hole 341 on one end to couple with one end of an axle C1 and a bucking flap 342 located on another end and bent downwards to press an inner rim of the ram head 325 of the slide shank 32; and a swing plate 35 having one side extended to form an elongated arm with a tip 354 to press against a side wall 329 of the slide shank to form a brake and a rear end formed a claw 351 to latch on the notch 337 of the axle member 33, and is movable on the perimeter of the axle member 33. The swing plate 3 further has an axle hole 352 for coupling with the strut F3 of the bolt dock 21 that also is coupled with a torsional spring D1, and a lug 353 to latch one end of the torsional spring D1;

the lower bolt set 4 includes:

a lower bolt 41 for running through the lower bolt openings 213 and 213' of the bolt dock 21 having one side formed a sloped surface 411 and another side extending rearwards to form a stem 412 for coupling with a spring B2. The stem 412 has a groove 413;

a slide member 42 coupling on the guide rail 216 of the bolt dock 21 and having a semicircular trough 421 formed on a front end at the right side to house the stem 412 of the lower bolt 41 and the spring B2 and a wedge plate 45 engaged with the stem, and another semicircular trough 422 formed on the rear end to house another spring B3. The slide member 42 further has a ridge 423 formed on the left side to couple with the slide flute 222 of the lid 22 for moving horizontally within a limited distance. The slide member also has a retaining axle 424 located on an upper side;

a push arm 43 having one end formed an axle hole 431 to couple with the strut F5 of the bolt dock 21 and another end formed a cavity 432 to hold one end of the spring B3. The cavity 432 also couples with the guide rail 216 of the bolt dock 21. There is a trough 433 formed on one side of the cavity 432 to hold one end of the torsional spring D1;

a rocker plate 44 formed like a hook having an axle hole 441 on the corner section and a notch 442. The axle hole 441 is coupled with a pintle C2 which is also coupled with the axle hole G1 of the bolt dock 21 and the axle hole G3 of the lid 22, and is located therebetween; and a wedge plate 45 having a notch 451 formed on one side to clip the groove 413 of the stem 412 of the lower bolt 41 and a bent flap 452 on another side to latch on the slide member 42;

the outer handle 5 is located on the outer side of the door to form a chain movement with the upper bolt set 3, the lower bolt set 4 and the inner handle 6 through a linkage rod 7, and is coupled with a plurality of connecting struts E to fasten respectively the outer handle 5 and the inner handle 6 to the outer side and the inner side of the door; and the inner handle 6 is located on the inner side of the door to form a chain movement with the upper bolt set 3, the lower bolt set 4 and the outer handle 5 through the linkage rod 7, and is coupled with a plurality of connecting struts E to fasten respectively the outer handle 5 and the inner handle 6 to the outer side and the inner side of the door.

By means of the construction set forth above, when the door is closed, the door lock of the invention will lock automatically, and deformation may be prevented from occurring to the bolt.

Figure 6:
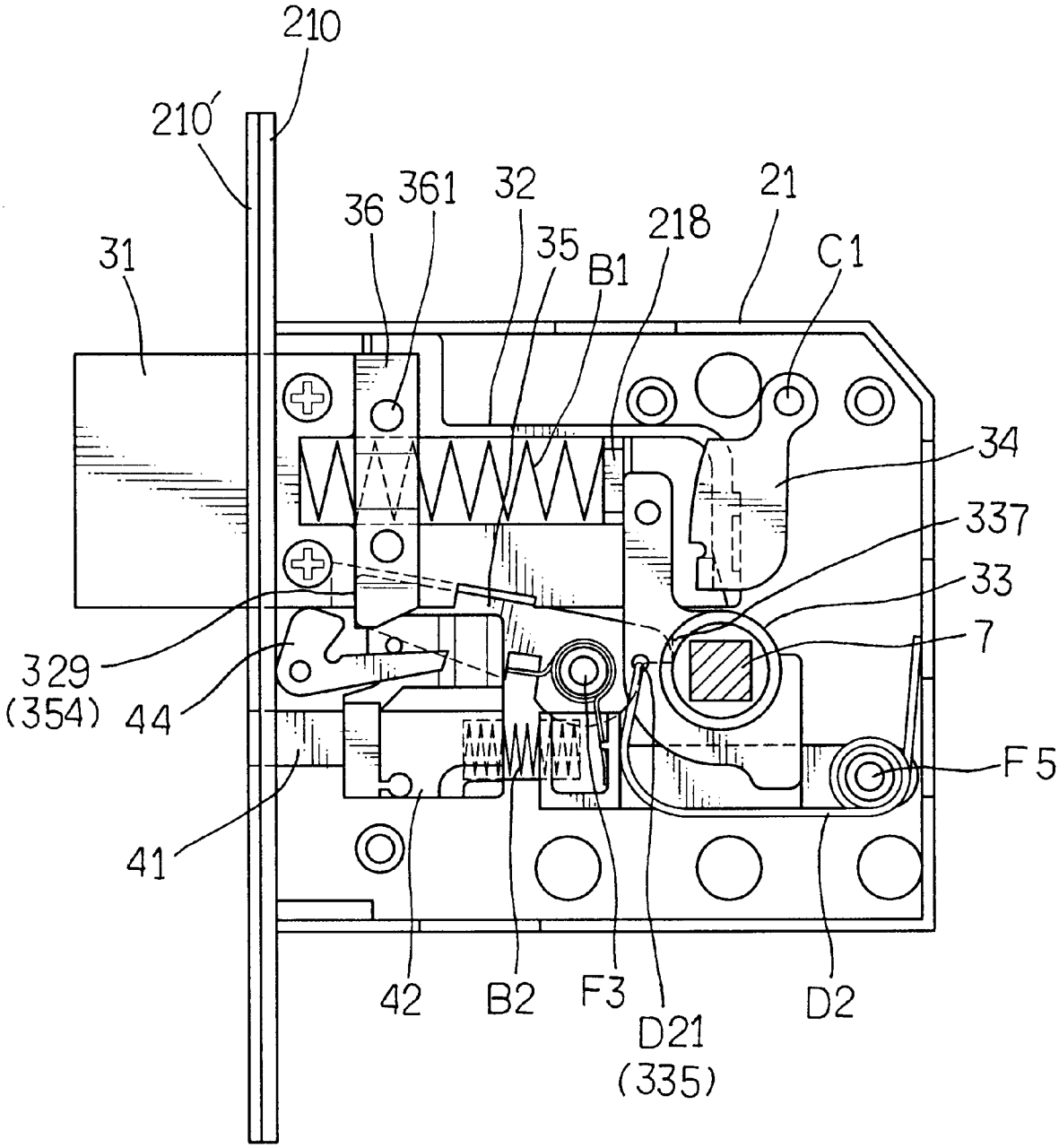
FIG. 6 is a schematic view of the invention in an operating condition −1.
Figure 7:
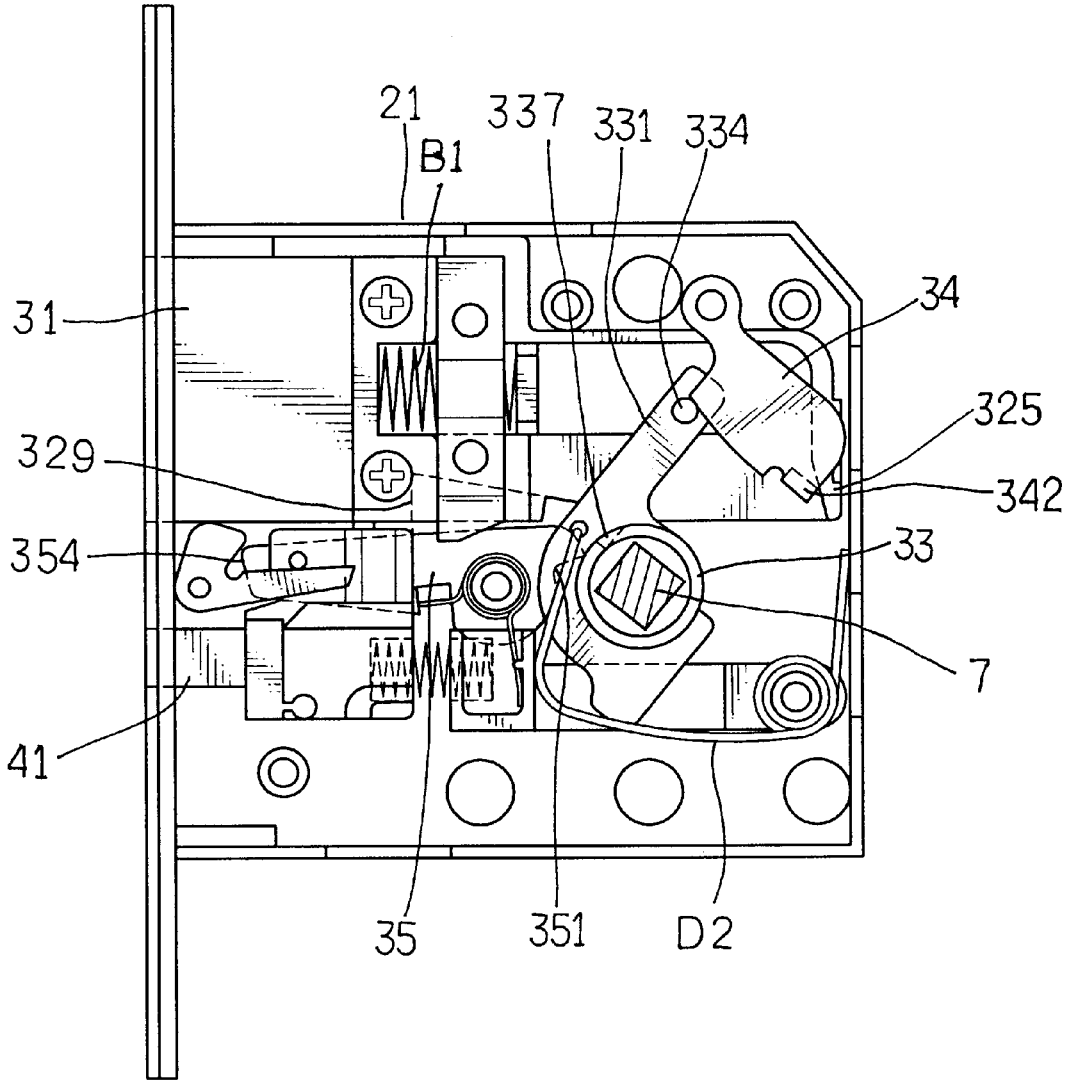
FIG. 7 is a schematic view of the invention in an operating condition −2.
Figure 8:
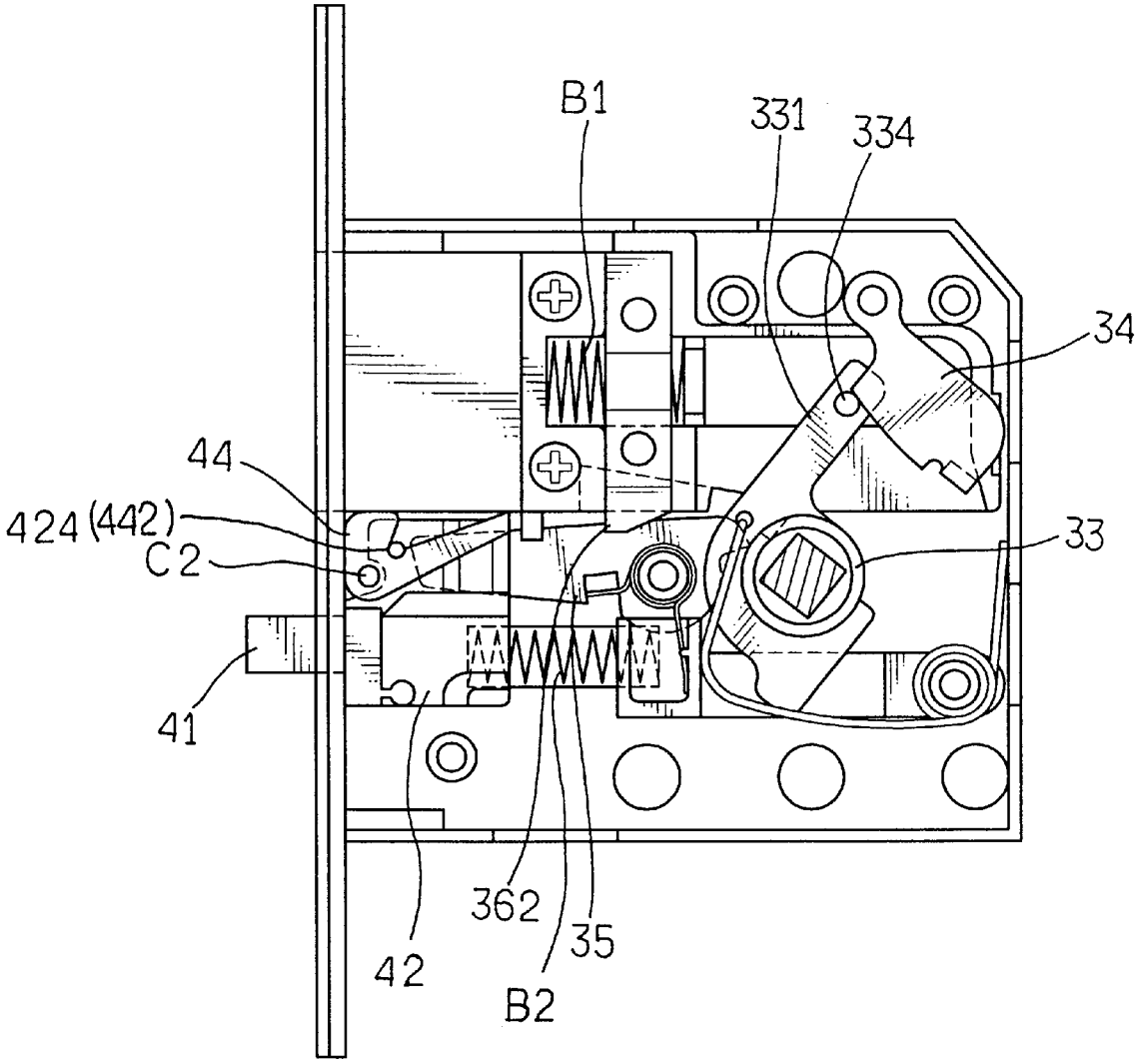
FIG. 8 is a schematic view of the invention in an operating condition −3.
Figure 9:
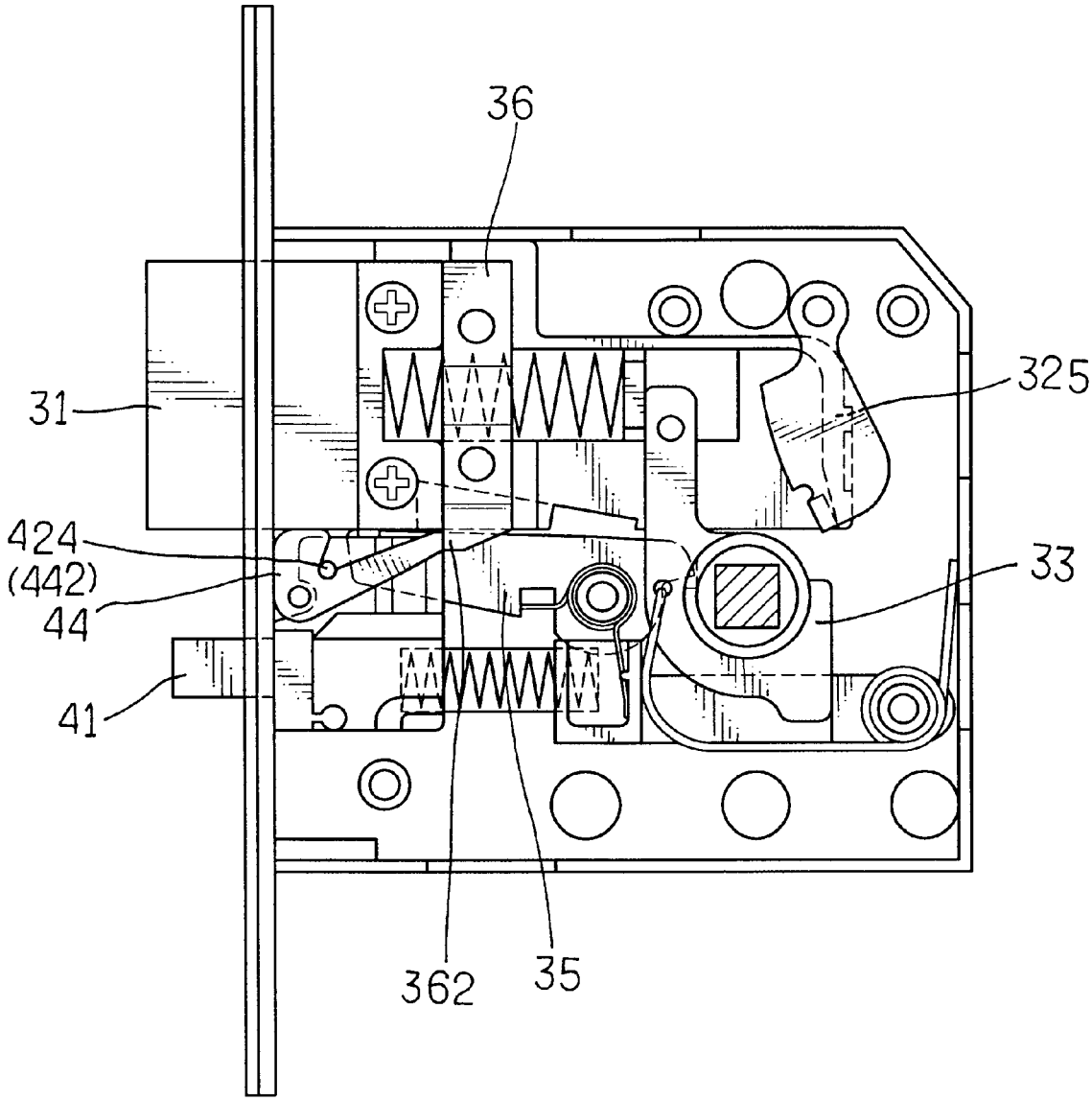
FIG. 9 is a schematic view of the invention in an operating condition −4.
Figure 10:
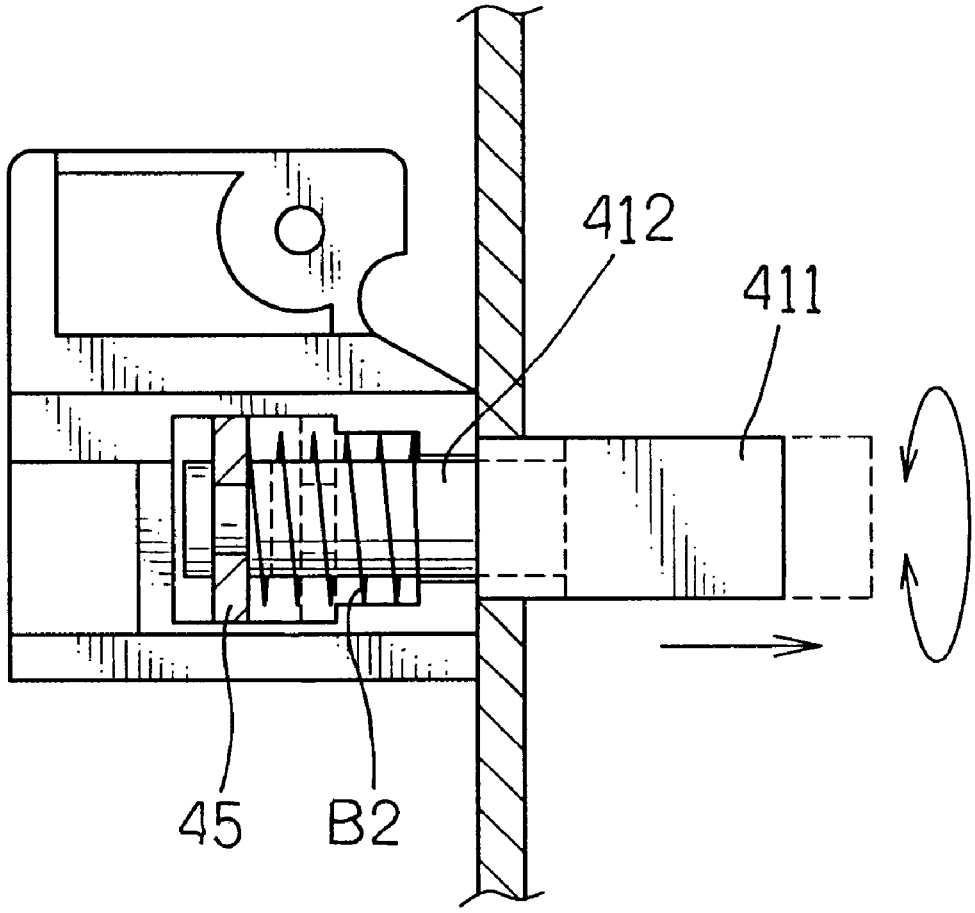
FIG. 10 is a schematic view of the invention with the lower bolt in another direction and in an operating condition.

Operation of the invention is as follows:

1. Referring to FIG. 6, when the door lock is in a locked condition, the lower bolt 41 cannot be extended outwards due to no space is formed to accommodate it on the door, therefore it compresses the spring B2 and B3 and is retracted into the bolt dock 21 in the slide flute 222 of the lid 22, while the upper bolt 31 is fully extended outwards.
2. When to open the door, turn the inner and outer handle 6 and 5 simultaneously, the outer handle 5 turns the linkage rod 7 which turns the axle member 33 and the inner handle 6, and the claw 351 of the swing plate 35 escapes from the notch 337 of the axle member 33 and moves on the perimeter of the axle member 33 to a lower elevation, and the tip 354 of the swing plate 35 no longer latches on the lower side wall 329 of the slide shank 32. Therefore the slide shank 32 is moved by the trigger plate 34 and retracts rearwards (as shown in FIG. 7).
3. Then the stub shaft 334 of the upper bucking arm 331 of the axle member 33 pushes the trigger plate 34, and the bucking flap 342 of the trigger plate 34 presses the ram head 325 of the slide shank 32 to move the slide shank 32 rearwards. The upper bolt 31 is moved rearwards and the spring B1 is compressed, thus the door may be opened (as shown in FIG. 7).
4. When the door is opened, the lower bolt 41 is no longer subject to compression, and is pushed outwards by the restoring spring B2 and B3. Meanwhile, the retaining axle 424 of the slide member 42 drops in the notch 442 of the rocker plate 44 to raise the rocker plate 44 upwards to enable the slide shank 32 to press the lower rim 362 of the cover plate 36 during returning movement so that the slide shank 32 cannot return completely (as shown in FIGS. 8 and 9).
5. When the user releases the handle and the handle returns to its original position, the linkage rod 7 and the torsional spring D2 move the axle member 33 to its original position. Meanwhile, the trigger plate 34 is not pushed by the axle member 33 and does not press the slide shank 32, but rather return to its original position resulting from the pressing of the slide shank 32 caused by the returning force of the spring B1. When the slide shank 32 is moved half way by the spring force, the rocker plate 44 is raised to stop the lower rim 362 of the cover plate 36 such that the front rim of the slide shank 32 cannot fully touch the inner side of the upper bolt opening 212, while the upper bolt 31 and the lower bolt 41 are extended outside the upper bolt openings 212 and 212' and lower bolt openings 213 and 213' to form a movable condition (as shown in FIG. 9).
6. When the user closes the door, the door frame presses the upper bolt 31 and the lower bolt 41 to make them retracting. The slide member 42 of the lower bolt 41 retracts rearwards and the retaining axle 424 presses the rocker plate 44 such that the rocker plate 44 turns and escapes from the lower rim 362 of the cover plate 36. The upper bolt 31 is pushed by the spring B1 and extends outwards into the cavity formed in the door frame, meanwhile the slide shank 32 is no longer stopped by the rocker plate 44 and extends outwards fully. Thus an automatic locking is accomplished (as shown in FIG. 6).
7. In the event that the door is opened in a different direction and the locations of the upper bolt 31 and the lower bolt 41 should be changed, the upper bolt 31 may be moved to the direction desired and fastened by the screw A. The lower bolt 41 may be directly turned to the new direction (as shown in FIG. 10).

By means of the construction set forth above, the door may be locked automatically when closed, and the bolt may be prevented from deforming, and safe locking and longer durability of the door lock can be achieved.

I claim:

1. An improved bolt dock for a door lock comprising an upper bolt set and a lower bolt set covered by a lid to couple with an inner handle and an outer handle to be installed on a door, wherein:

the bolt dock has a casing which has a face plate and a guard plate located on one side thereof, the face plate and the guard plate having respectively a plurality of fastening holes located on an upper side and a lower side thereof, and an upper bolt opening and a lower bolt opening, the bolt dock also has a plurality of struts and a plurality of axle holes located in the interior, each strut having a screw hole formed therein, the bolt dock further has a guide rail located at a lower section below the center thereof and a retaining plate located on an upper section of the center of the bolt dock corresponding to the upper bolt opening;

the lid corresponds to the bolt dock and has a plurality of axle holes and a plurality of apertures corresponding to the struts of the bolt dock to receive screws for fastening, the lid also has a transverse slide flute formed on one side in the center thereof;

the upper bolt set includes:

an upper bolt for running through the upper bolt openings having a sloped surface on one side and a fastening section extending from another side thereof;

a slide shank having one side extending to form a ram head, another side forming a wedge trough to couple with the fastening section of the upper bolt, a longitudinal trough formed on an inner side of the wedge trough and a transverse trough normal to the longitudinal trough in a staggered manner, the transverse trough having one end to receive the retaining plate of the bolt dock to form a retaining position and housing a spring, the longitudinal trough being covered by a cover plate which is fixedly fastened by rivets running through two round holes formed on the cover plate;

an axle member having a hollow barrel with a square opening formed therein, an upper bucking arm extending upwards and a lower bucking arm extending downwards;

a trigger plate formed in an arched shape having an axle hole on one end to couple with one end of an axle and a bucking flap located on another end and bent downwards to press an inner rim of the ram head of the slide shank;

a trigger plate formed in an arched shape having an axle hole on one end to couple with one end of an axle and a bucking flap located on another end and bent downwards to press an inner rim of the ram head of the slide shank; and a swing plate having one side extended to form an elongated arm with a tip to press against a side wall of the slide shank to form a brake; and the lower bolt set includes:

a lower bolt for running through the lower bolt openings having one side formed a sloped surface and another side extending rearwards to form a stem for coupling with a spring, the stem having a groove;

a slide member coupling on the guide rail of the bolt dock and having a semicircular trough formed on a front section at the right side to house the stem of the lower bolt and the spring and a wedge plate, and another semicircular trough formed on a rear section to house another spring, the slide member further has a ridge formed on a left side to couple with the slide flute of the lid for moving horizontally within a limited distance, the slide member also has a retaining axle located on an upper side thereof;

a push arm having one end formed an axle hole to couple with the strut of the bolt dock and another end formed a cavity to hold one end of a spring, the cavity being coupled with the guide rail of the bolt dock and having one side with a trough formed thereon to hold one end of a the torsional spring;

a rocker plate formed in a hook shape having an axle hole on a corner section and a notch, the axle hole being coupled with a pintle which is located between the bolt dock and the lid and being coupled with the axle holes formed thereon; and a wedge plate having a notch formed on one side to clip the groove of the stem of the lower bolt and a bent flap on another side to latch on the slide member;

wherein the upper bolt and the lower bolt lock the door automatically when closed and are free from deformation.

2. The improved bolt dock of claim 1, wherein the fastening section of the upper bolt has two fastening holed formed thereon.

3. The improved bolt dock of claim 1, wherein the wedge trough of the slide shank has a side wall which has two fastening holes formed thereon.

4. The improved bolt dock of claim 1, wherein the upper bucking arm of the axle member has one side forming a stub shaft and a round hole for receiving one end of a spring, the hollow barrel having a bottom rim on another side with a notch formed thereon, the axle member being located between the bolt dock and the lid and coupled with the axles holes formed thereon.

5. The improved bolt dock of claim 1, wherein the swing plate has a rear end forming a claw to latch on the notch of the axle member, and being movable on the perimeter of the axle member, the swing plate further has an axle hole closed to the claw for coupling with the strut of the bolt dock with a torsional spring coupled thereon, and a lug to latch one end of the torsional spring.

* * * * *